United States Patent [19]

Gschwender

[11] Patent Number: 4,669,953

[45] Date of Patent: Jun. 2, 1987

[54] PUMP, ESPECIALLY DRUM OR IMMERSION PUMP

[75] Inventor: Alois Gschwender, Neubulach, Fed. Rep. of Germany

[73] Assignee: Flux-Geräte Gesellschaft mit beschränkter Haftung, Stuttgart, Fed. Rep. of Germany

[21] Appl. No.: 636,867

[22] Filed: Aug. 2, 1984

[30] Foreign Application Priority Data

Aug. 6, 1983 [DE] Fed. Rep. of Germany ..... 3328484

[51] Int. Cl.[4] ..... F04D 13/08

[52] U.S. Cl. ..... 415/169 R; 415/112; 415/108; 415/142; 415/501

[58] Field of Search ..... 415/501, 170 R, 110, 415/111, 112, 108, 168, 169 R, 169 A, 142, 219 R, DIG. 3, 122 R; 417/424

[56] References Cited

U.S. PATENT DOCUMENTS

| | | | |
|---|---|---|---|
| 1,004,822 | 10/1911 | Scheurmann | 415/112 |
| 1,141,010 | 5/1915 | Scheurmann | 415/501 |
| 1,170,512 | 2/1916 | Chapman | 415/501 |
| 1,170,574 | 2/1916 | Sperry | 415/501 |
| 1,228,770 | 6/1917 | Halstead | 415/112 |
| 1,266,552 | 5/1918 | Chapman | 415/501 |
| 1,272,681 | 7/1918 | Layne | 415/112 |
| 1,304,068 | 5/1919 | Krogh | 415/168 |
| 1,491,150 | 4/1924 | Layne et al. | 415/112 |
| 1,677,262 | 7/1928 | Wintroath | 415/169 A |
| 1,924,203 | 8/1933 | Wintroath | 415/112 |
| 1,999,163 | 4/1935 | Allen | 415/112 |
| 2,161,862 | 6/1939 | Hait | 415/111 |
| 2,288,902 | 7/1942 | Hartman | 415/169 R |
| 2,764,943 | 10/1956 | Peters | 417/424 |
| 2,811,109 | 10/1957 | Brill et al. | 415/112 |
| 2,875,697 | 3/1959 | Fernstrum | 415/112 |
| 3,123,338 | 3/1964 | Borden | 415/112 |
| 3,291,057 | 12/1966 | Carle | 415/501 |
| 4,260,031 | 4/1981 | Jackson, Jr. | 415/111 |
| 4,530,641 | 7/1985 | Gschwender | 415/170 R |

FOREIGN PATENT DOCUMENTS

| | | | |
|---|---|---|---|
| 2750801 | 5/1979 | Fed. Rep. of Germany | 415/169 R |
| 651619 | 4/1951 | United Kingdom | 415/112 |
| 685455 | 1/1953 | United Kingdom | 415/112 |

*Primary Examiner*—Everette A. Powell, Jr.
*Attorney, Agent, or Firm*—Becker & Becker, Inc.

[57] ABSTRACT

A pump having a main shaft which is rotatably supported in a support housing via support bearings. The support bearings are provided with passages which are connected via discharge openings with the space around the pump. As a result, no pressure can build up between the support bearings and a bearing disposed at the lower end of the shaft. Medium which during operation of the pump gets by the seals and the support bearings can flow off out of the pump through these passages and the discharge openings.

14 Claims, 9 Drawing Figures

PUMP, ESPECIALLY DRUM OR IMMERSION PUMP

FIELD OF THE INVENTION

1. Background of the Invention

The present invention relates to a pump, especially a drum or immersion pump, having a main shaft, one end of which is connected to a drive unit, with the main shaft being supported in a support housing by means of at least one bearing. The other end of the main shaft supports a rotor which is disposed in a rotor chamber which is adjacent to a lower bearing of the main shaft and from which extends at least one riser channel, which is parallel to the support housing, in the direction toward the drive unit, and an outlet for the medium which is being conveyed.

2. Description of the Prior Art

With the heretofore known drum pumps, the main shaft is mounted in a coaxially disposed support housing which is surrounded by the annular riser channel. The shaft is mounted in the support housing in friction bearings which are lubricated with grease or oil. Behind the rotor, the shaft is sealed off by means of a slide ring seal and/or a radial shaft seal. Within the support housing, the main shaft is supported by a plurality of support bearings. The hollow spaces in the support housing are filled with lubricant, such as grease or oil. During the pumping process, a small amount of the medium can get by the seals and the support bearings and can enter the support housing. The support bearings and at least the upper portion of the shaft, especially with corrosive media, are then chemically attacked and the lubricant is broken up. This results in disturbances in operation, and even leads to complete failure of the pump.

An object of the present invention is to embody a pump of the aforementioned general type in such a way that, within the support housing, the medium, which is to be conveyed, cannot rise upwardly toward the drive unit past the support bearings.

BRIEF DESCRIPTION OF THE DRAWINGS

This object, and other objects and advantages of the present invention, will appear more clearly from the following specification in conjunction with the accompanying drawings, in which.

SUMMARY OF THE INVENTION

Figure 1:
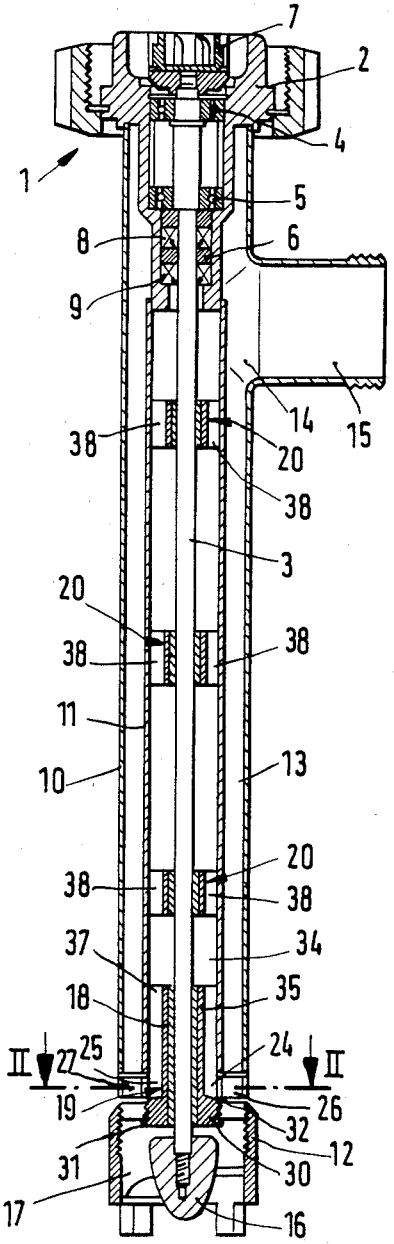
FIG. 1 is an axial cross-sectional view taken through one inventive embodiment of a pump.

The pump of the present invention is characterized primarily in that the support bearings, in order to form a passage, are provided with a reduced cross section in comparison to the cross section of an inner chamber of the support housing, which inner chamber surrounds the main shaft; the passages communicate with the space around the pump by means of at least one discharge opening.

With the pump of the present invention, the support bearing does not completely fill the inner chamber of the support housing, since the cross section of the support bearing is less than the cross section of this inner chamber which surrounds the main shaft. Since the passage of the support bearing is connected with the receptacle chamber via the discharge opening, no pressure can build up between the support bearing and the bearing disposed at the bottom end of the shaft. As soon as liquid has entered the support housing, the pressure of the medium is reduced, so that the medium within the support housing cannot rise past the support bearing. This assures that, during operation of the pump, liquid which has entered the support housing cannot reach the drive unit.

Pursuant to a specific feature of the present invention, the passage of the support bearing may be formed by at least one axial flow channel.

The pump of the present invention may be further characterized in that the lower bearing, in order to form a passage, is provided with a reduced cross section compared to the cross section of the inner chamber which is surrounded by the support housing, at least in the region of the lower bearing. The passage of the lower bearing may be an axially extending channel.

The bottom bearing is preferably the lower termination and seal of the support housing, and is mounted on the inner wall of the latter. The channel of the lower bearing may be essentially aligned with the passage of the support bearing, and is preferably in direct communication therewith. The riser channel may be formed between the support housing and a riser which surrounds the latter. The bottom end of the riser preferably is connected to a rotor housing which projects axially beyond the riser and into which the lower end of the support housing projects.

The discharge opening, which opens into the space around the pump, may be provided in the rotor housing, preferably in the region axially beyond the riser, and preferably is connected by means of a tube with the passage of the lower bearing. The passage may be provided in the outer region of the support bearing, and preferably is formed by an axially extending recess in the periphery of the support bearing; from this recess, at least one connecting channel extends to the main shaft. The support bearing may be cage-like, and preferably has annular elements which are connected to a cylindrical inner portion which surrounds the main shaft, and expediently rest against the inner wall of the support housing.

The support bearing, which preferably extends from the lower bearing to the drive unit, comprises two bearing parts which are mirror symmetrical to one another and which rest against the inner wall of the support housing; the passage is formed between the bearing parts, and preferably extends to the main shaft.

The passage may extend from the main shaft to the inner wall of the support housing, and preferably widens continuously radially outwardly from the main shaft to the support housing.

DESCRIPTION OF PREFERRED EMBODIMENTS

Referring now to the drawings in detail, the pump illustrated in FIG. 1 is a drum pump which, as an immersion pump, is introduced from above into the liquid which is to be conveyed. The pump includes a drive unit 1 having a housing 2 in which, by means of two ball bearings 4,5 and a sleeve bearing 6, the upper end of a drive or main shaft 3 is rotatably supported. A coupling 7 is disposed at the upper end of the main shaft 3. The drum pump can be connected by means of the coupling 7 to the shaft of a non-illustrated drive motor, for example an electric motor. The sleeve bearing 6, which is disposed between two seals or gaskets 8 and 9, acts as a restricting section for vapors and gases that can bubble up out of the liquid which is to be conveyed. Consequently, the ball bearings 4,5 are to a large extent protected against corrosion and similar damage which can be caused by such gaseous media. The lower gasket 9 is preferably a lip gasket which is disposed in the lower passage of the bearing housing 2.

The main shaft 3 is surrounded by a riser 10 and a tubular support housing 11. The riser 10 is disposed coaxial to the main shaft 3, and extends from a rotor housing 12 to the bearing housing 2. The support housing 11 has a rectangular cross section, and also extends from the rotor housing 12 to the bearing housing 2, which is placed in the upper end of the support housing 11. An uptake or riser channel 13 is formed between the riser 10 and the support housing 11. In the region below the bearing housing 2, the riser channel 13 joins a collecting chamber 14 into which an outlet 15 opens out. So that the liquid which is to be conveyed cannot pass into the drive unit 1, or the bearings 4–6, both the riser 10 and the support housing 11 are connected to the bearing housing 2 in such a way as to be sealed relative to pressurized medium.

A rotor 16 is mounted on that end of the main shaft 3 which is remote from the drive unit 1. The rotor 16 is rotatably disposed within a rotor chamber 17 in the rotor housing 12. The rotor housing 12 is open toward the bottom. Above the rotor 16, the main shaft 3 is supported by a guide bearing 18, the ends of which project into the support housing 11 as well as into the rotor housing 12. As shown in FIG. 1, the greatest portion of the length of the guide bearing 18 is located in the support housing 11. The sleeve-like guide bearing 18 is disposed in a holder 19 which is mounted in the support housing 11 and in the rotor housing 12. In the region between the guide bearing 18 and the bearing housing 2, the main shaft 3 is supported within the support housing 11 by means of support bearings 20 which are distributed over the length of the shaft 3.

Figure 2:
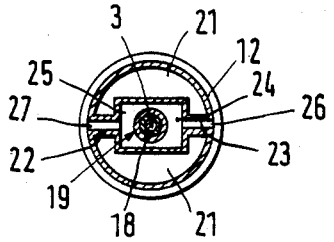
FIG. 2 is a cross-sectional view taken along the line II—II in FIG. 1.

As shown in FIG. 2, between the riser 10 and the support housing 11, the riser channel 13 communicates with channel portions 21 which are provided in the housing 11. The channel portions 21 are in the form of circular sectors, with two essentially parallel tubular pieces 22,23 passing therethrough.

During operation, the main shaft 3 and hence the rotor 16 are rotated by means of the drive motor. As a result, the liquid is conveyed upwardly in the riser channels 13, 21 to the collecting chamber 14, from where the liquid can pass into the outlet 15. From the rotor chamber 17, the liquid which is to be conveyed can also pass into the region between the main shaft 3 and the guide bearing 18. This results in a lubricating effect, which can be very desirable. However, the liquid should not be able to rise in the region between the main shaft 3 and the support housing 11 to the drive unit 1 or the bearing housing 2. This is prevented primarily by providing an increase in volume of the space between the main shaft 3 and the support housing 11 in the region between the guide bearing 18 and the adjacent support bearing 20; as a result, the pressure drops immediately after the liquid has passed the guide bearing 18. The lubricating film formed on the main shaft 3 remains, but the liquid, that has entered, does not rise too far nor is it accelerated upwardly. So that the liquid which has entered the support housing 11 can immediately flow downwardly again, the holder 19 is provided with at least one, and preferably two, passages 24, 25 which open into discharge openings 26,27 of the support housing 11. As shown in FIG. 2, they are provided at diagonally opposed locations of the support housing 11. The discharge openings 26, 27 are formed by the tubular pieces 22, 23 between the support housing 11 and the riser 10.

The holder 19 can be rigidly mounted in the support housing 11 in a simple manner. For this purpose, at that end which faces the rotor 16, the holder 19 is provided with a radial collar 30 having a predetermined contour. Along its outer edge, the collar 30 is provided with a shoulder 31 on which the lower end face 32 of the support housing 11 is seated. The collar 30 of the holder 19 can be screwed, glued, welded, or otherwise fastened to the support housing 11. The collar 30 is disposed at the level of the lower edge of the lateral discharge openings 26, 27 of the support housing 11 (FIG. 1). The medium flowing out of the inner chamber 34 of the support housing 11 is deflected at this collar 30 in the direction of the discharge openings 26, 27.

The collar 30 is mounted on a sleeve 35 which has the same height as the guide bearing 18, which rests against the outer wall of the sleeve 35. The sleeve 35 and the collar 30 preferably are produced unitarily. The support housing 11 can have a circular or angular contour.

At least one, and preferably at least two, oppositely disposed and axially extending passages 37 pass through the sleeve 35 and open into the radially disposed passages 24, 25 of the holder 19. After passing between the main shaft 3 and the guide bearing 18, the liquid located in the inner chamber 34 can flow off immediately downwardly through the passages 37 and can flow outwardly through the passages 24, 25 and the discharge openings 26,27.

Since the discharge openings 26, 27 are disposed in the axially lower region of the drum pump, when the pump is removed from the liquid which is to be conveyed, any liquid which still remains in the support housing 11 can quickly flow off in an unimpeded manner, so that chemical attack, especially with corrosive media, by liquid later dripping out of the support housing is avoided.

The inner chamber 34 of the support housing 11 is annular between the main shaft 3 and the support housing, and extends from the guide bearing 18 to the outlet 15. So that this annular inner chamber 34 is not interrupted by the support bearings 20, and so that no pressure can build up between the support bearings 20 as well as between the guide bearing 18 and the adjacent support bearing 20, which pressure would lead to a rising of the liquid in the direction toward the drive unit 1, the support bearings 20 have a reduced cross section in comparison to the cross section of the inner chamber 34 which surrounds the main shaft 3. This is achieved by providing the support bearings 20 with axial grooves 38 which pass through the bearings 20. These grooves 38 produce connecting channels between the individual portions of the inner chamber 34 disposed between the support bearings 20, so that no pressure build-up is possible. Furthermore, these grooves 38 assure that liquid, which possibly penetrates between the support bearings 20 and the main shaft 3, can flow back through these axial grooves 38, so that such liquid can pass through the passages 37 of the holder 19 to the discharge openings 26, 27. As shown in FIG. 1, the grooves 38 are delimited radially outwardly by the support housing 11.

The inner chamber 34 is sealed off relative to the riser channels 13. In this embodiment, the main shaft 3 is made of solid material. The riser 10 and the support housing 11 can be molded parts made of a chemically resistant synthetic material. They can also comprise metal, for example high-quality steel or aluminum. The support bearings 20 fastened to the inner wall of the support housing 11 in a suitable manner, for example by being joined, glued, or soldered thereto. In this embodiment, the axial grooves 38 are disposed diagonally opposite one another relative to the main shaft 3. The support bearings 20, of course, also can be provided with just a single axial groove, a plurality of axial grooves, or, for example, an annular chamber.

Figure 3:
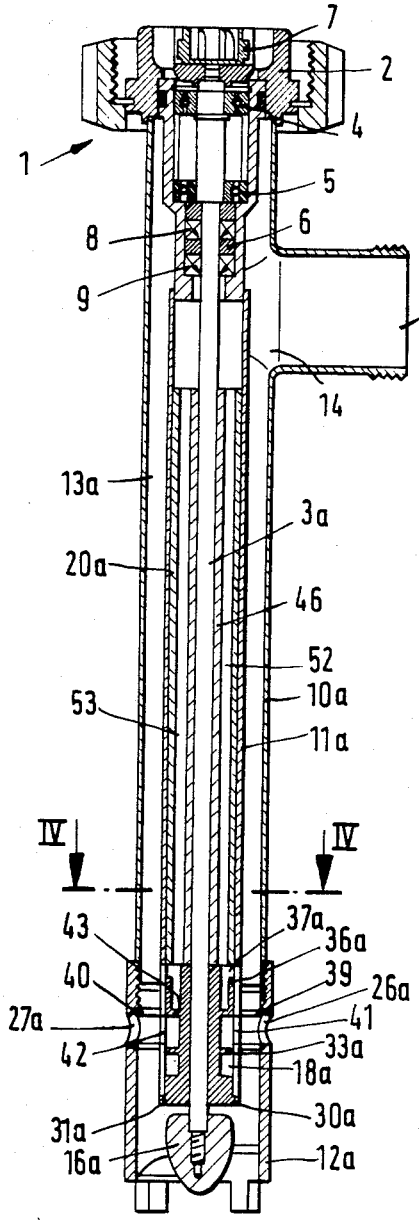
FIG. 3 is an axial section of the lower portion of a second inventive embodiment of a pump.
Figure 4:
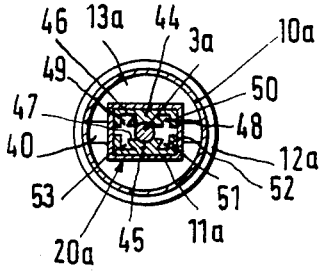
FIG. 4 is a cross-sectional view taken along the line IV—IV in FIG. 3.

With the exception of the differences which are to be described subsequently, the embodiment of FIGS. 3 and 4 corresponds to the embodiment of FIGS. 1 and 2. The rotor housing **12*a* is a circular sleeve in which the similarly cylindrical riser 10*a* is disposed. In order to assure simple assembly, the riser 10*a* preferably is screwed into the rotor housing 12*a*. On diagonally opposite sides, the rotor housing 12*a* is provided with the discharge openings 26*a*, 27*a*, to which are connected radial tubular pieces 39, 40 which connect the discharge openings 26*a*, 27*a* with outlet openings 41, 42 in the support housing 11*a*. The tubular pieces 39, 40 preferably are welded onto the inner wall of the rotor housing 12*a* and onto the outer side of the tubular support housing 11*a*. The tubular pieces 39, 40 thus form mounting means for the support housing 11*a*, with which it is held within the rotor housing 12*a*. As shown in FIG. 4, the support housing 11*a* has a rectangular contour, and is spaced on all sides from the riser 10*a*. The guide bearing 18*a* is disposed in the lower end of the support housing 11*a*, and in this embodiment is unitary with the holder. That end of the guide bearing 18*a* which faces the rotor 16*a* is provided with the collar 30*a* having the shoulder 31*a* upon which the support housing 11*a* is seated. The collar 30*a* has the same contour as does support housing 11*a*, so that no gap is formed at the junction of the support housing with the collar. At an axial distance from the collar 30*a*, the guide bearing 18*a* is provided with a further collar 33*a*, which is also mounted on the inner wall of the support housing 11*a* in such a way as to be sealed relative to medium, and is disposed at the level of the lower edge of the tubular pieces 39, 40 (FIG. 3). The guide bearing 18*a* is finally provided with a fastening part 36*a* which is in the form of a ring and also rests against and is fastened to the inner wall of the support housing 11*a*. By means of a flange 43 at its lower end, the fastening part 36*a* is connected with that part of the guide bearing 18*a* which rests against the main shaft 3*a*. The guide bearing 18*a* with the collars 30*a* and 33*a*, the fastening part 36*a*, and the flange 43 is preferably made in one piece. The underside of the flange 43 is disposed at the level of the upper edge of the outlet openings of the support housing 11*a* (FIG. 3). The fastening part 36*a* surrounds and is spaced from that bearing part which rests against the main shaft 3*a*, and extends axially upwardly from the flange 43. As a result, there is achieved engagement of the guide bearing 18*a* on the inner wall of the support housing 11*a* over a large surface area, so that the bottom end of the main shaft 3*a* is reliably supported. At least one passage (not illustrated) is provided in the flange 43 in order to provide a connection between the openings 26*a*, 27*a*, 41, 42 and the inner space 37*a* of the support housing 11*a* above the flange 43. At the collar 33*a*, which seals off the inner space 37*a* of the support housing 11*a* in the direction of the rotor 16*a*, the liquid which flows through the passage is deflected to the tubular pieces 39, 40, so that it passes to the discharge openings 26*a*, 27*a*** and can flow out of the drum pump.

Seated on the guide bearing **18*a* is a support bearing 20*a* which in this embodiment extends upwardly to the non-illustrated bearing housing, but could also comprise adjoining support bearing sections. As shown in FIG. 4, this single support bearing 20*a* is formed of two mirror-symmetrical bearing parts 44 and 45 which are accommodated in the support housing 11*a*, have an essentially C-shaped cross section, and rest against the inner walls of the support housing 11*a*. Halfway along their length, both bearing parts 44, 45 are provided with a partially cylindrical receiving means 46 and 47 which rest against a little less than 180° of the main shaft 3*a*. Thus, two axial gaps 48 and 49, which extend over the entire length of the support bearing 20*a*, are formed between the opposed end faces of the receiving means 46 and 47**.

The receiving means 46 and 47 are spaced from the legs 50 and 51 of the two bearing parts 44, 45. Consequently, axially extending flow channels 52 and 53 are formed between the receiving means 46, 47 and the legs 50, 51. The flow channels 52, 53 communicate with the non-illustrated passages of the guide bearing **18*a*. Also with this embodiment, the support bearing 20*a* has a reduced cross section compared to the cross section of the inner space 37*a* of the support housing 11*a* which surrounds the main shaft 3*a***.

Liquid which has possibly passed between the support bearing **20*a* and the main shaft 3*a*, can pass through the gaps 48 and 49 into the flow channels 52, 53, and can flow downwardly to the discharge openings 26*a*, 27*a* of the rotor housing 12*a*. This prevents the liquid or fluid, during operation of the drum pump, from passing upwardly to the drive unit within the support housing 11*a***.

The support bearing **20*a*, the legs 50 and 51 of which are spaced from another and rest against the narrow sides of the support housing 11*a*, can be easily accommodated in the latter. The inner chamber 34*a* of the support housing 11*a* is reliably sealed off relative to the riser channel 13*a* between the riser 10*a* and the support housing 11*a*. Within the riser channel 13*a*, which is annular in this embodiment, the liquid which is to be conveyed flows upwardly toward the outlet 15 of the drum pump. Since the support bearing 20*a* extends between the guide bearing 18*a* and the bearing housing at the upper end of the main shaft, it is reliably supported. The liquid between the support bearing and the main shaft 3*a*, over the entire height of the support bearing, can pass via the gaps 48, 49 into the flow channels 52, 53, so that rising of the liquid to the driving unit is reliably prevented. A significant increase in volume of the inner chamber 34*a* between the main shaft 3*a* and the support housing 11*a* is achieved by the gaps 48, 49**, so that the liquid pressure within the support housing is reduced as soon as the liquid enters, resulting in an additional assurance against the rising of the liquid within the support housing.

The two receiving means 46 and 47 can also be integrally embodied, so that the support bearing 20*a* has a circular receiving means for the main shaft 3*a*. Since no gaps are provided in this case, liquid which passes between the main shaft and the support bearing 20*a* should still pass to the discharge openings 26*a*, 27*a*, so that the support bearing is provided with radial openings which are distributed over the length thereof and which can have a circular cross section or can be embodied as slits. These openings open out into the flow channels 52, 53. Such an integral construction of the support bearing has advantages with regard to manufacture and assembly.

Figure 5:
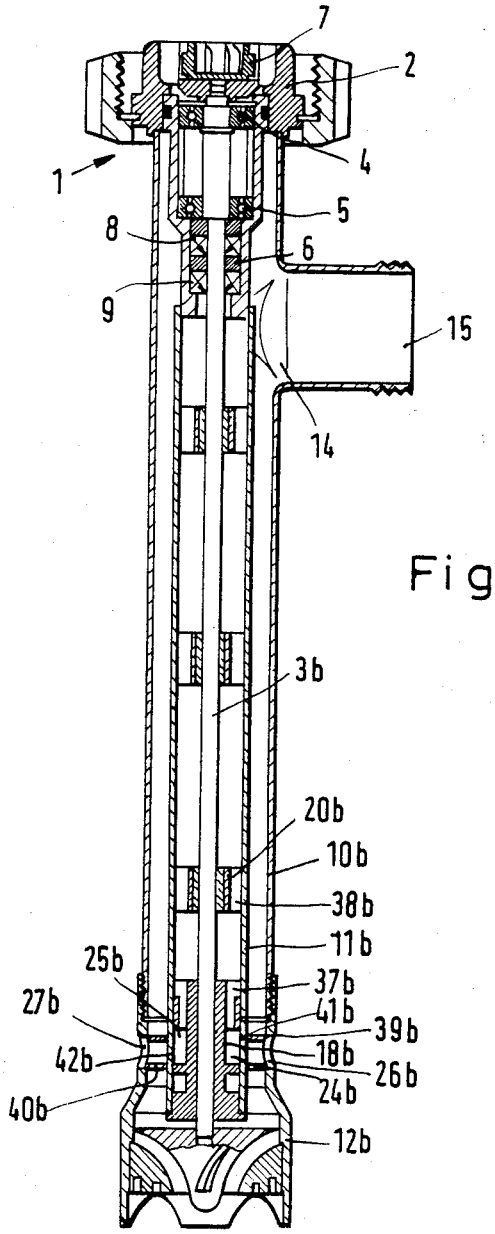
FIG. 5 is an axial cross-sectional view taken through the lower portion of a further inventive embodiment of a pump.

In the embodiment of FIG. 5, the guide bearing 18*b* is again integrally constructed with the holder. In other respects, the construction of the guide bearing 18*b* corresponds to the guide bearing of the embodiment of FIGS. 3 and 4. The support housing llb is again constructed in the same manner as in the embodiment of FIGS. 3 and 4. The riser 10*b* also corresponds in construction to that of the embodiment of FIGS. 3 and 4. The support housing 11*b* is connected to the rotor housing 12*b* by mean of the radial tubular pieces 39*b*, 40*b*. In conformity with the embodiment of FIGS. 1 and 2, the main shaft 3*b* is supported by support bearings 20*b* in the region above the guide bearing 18*b*. Liquid, which rises between the guide bearing 18*b* and the main shaft 3*b*, can flow downwardly via the passages 37*b* of the guide bearing to the passages 24*b* and 25*b*. The tubular pieces 39*b*, 40*b* connect the outlet openings 41*b*, 42*b* of the support housing 11*b* with the discharge openings 26*b*, 27*b* of the rotor housing 12*b*. The liquid located in the passages 24*b*, 25*b* can thus flow to the outside via the tubular pieces 39*b*, 40*b* and through the discharge openings 26*b*, 27*b*. Medium which possibly rises upwardly between the support bearings 20*b* and the main shaft 3*b* can flow downwardly through the axial grooves 38*b* to the discharge openings 26*b*, 27*b*.

Figure 6:
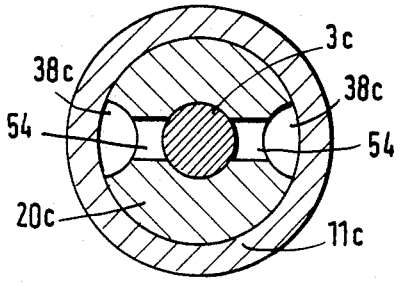
FIGS. 6–9 are radial cross-sectional view taken through different embodiments of support bearings for the inventive pumps.

The support bearing 20*c* illustrated in FIG. 6 is suitable for use in a cylindrical support housing 11*c*. The periphery of this support bearing is provided with two axial grooves 38*c* which are diametrically opposite one another and have a semicircular cross section. A respective channel 54 leads from each of these grooves 38*c* to the main shaft 3*c*. The support bearing 20*c*, which with the exception of the axial grooves 38*c* rests against the inner wall of the cylindrical support housing 11*c*, is secured in a suitable manner from rotating within the support housing. Medium, which rises upwardly between the support bearing 20*c* and the main shaft 3*c*, can flow downwardly to the discharge openings of the rotor housing in the manner previously described, thus reliably precluding medium from rising upwardly to the drive unit. In particular, the grooves 38*c* prevent a pressure build-up between the support bearings in the support housing 11*c*. The radially extending channels 54 make possible an additional lubrication of the main shaft 3*c* in the region of the support bearings 20*c* by means of the liquid which enters the inner chamber of the support housing 11*c*. In conformity with the embodiment of FIGS. 3 and 4, the support bearing 20*c* extends from the rotor housing or from the guide bearing to the bearing housing of the pump, but can also comprise adjoining support bearing sections. The channels 54 are distributed over the length of the support bearing 20*c*, and are embodied, for example, with a circular cross section or as elongated bores.

Figure 7:
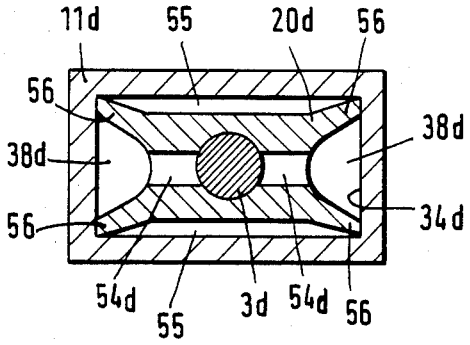

Pursuant to FIG. 7, the support bearing 20*d* is disposed in a support housing 11*d* having a rectangular cross section. The angular cross section simplifies the rigid disposition of the support bearing 20*d* in the support housing 11*d*. The support bearing 20*d*, which extends from the rotor housing or the guide bearing to the bearing housing of the pump, is provided with two axial grooves 38*d*, each of which faces a narrow side of the inner wall of the support housing 11*d* and has a cross section formed by approximately parabolic boundary lines. Flat recesses 55 are provided on the long sides of the support bearing 20*d*, as a result of which, in conjunction with the axial grooves 38*d*, four legs 56 are formed which are supported against the narrow sides of the support housing 11*d* in the corners thereof. With this embodiment also, the free inner chamber 34*d* of the support housing 11*d* is not interrupted by the axially successive support bearings 20*d*. Consequently, no pressure can build up in the region between the bearings, which pressure could lead to a rising of the liquid within the support housing. The support housing 11*d* can be utilized with a drum pump constructed in conformity with FIGS. 1, 3, or 5. The channels 54*d* again extend from the grooves 38*d* to the main shaft 3*d*, and can be embodied in the same manner as those in the embodiment of FIG. 6.

Figure 8:
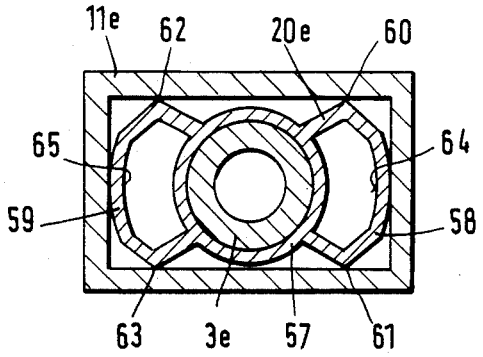

FIG. 8 illustrates a cage-like support bearing 20*e*. The main shaft 3*e*, which is in the form of a hollow shaft, is surrounded by a cylindrical inner portion 57 of the support bearing. Connected to the inner portion 57 are two partially annular elements 58 and 59 which, together with the inner portion 57, each form a hollow section and each have two contact edges 60 and 61 or 62 and 63 for the long sides of the support housing 11*e*. The slightly curved ends 64 and 65 of the elements 58 and 59 rest against the narrow sides of the support housing 11*e*. This shape of the support bearing 20*e* results in a large free cross section for the passage of liquid, yet provides a good support for the main shaft 3*e*. Therefore, no liquid pressure can build up between the bearings. The liquid can flow reliably downwardly in the aforementioned manner to the discharge openings in the rotor housing. The support bearings 20*e* are distributed over the length of the main shaft 3*e*.

Figure 9:
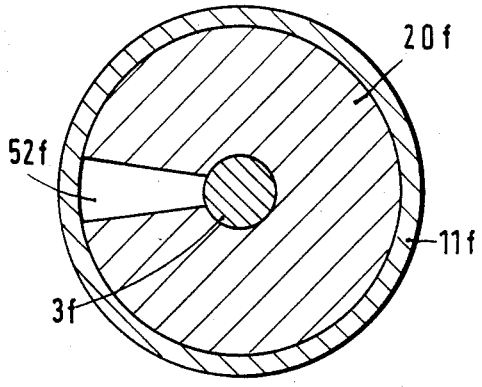

FIG. 9 shows an embodiment of a support bearing which extends from the rotor housing or the guide bearing to the bearing housing of the pump. The support bearing 20*f* nearly completely surrounds the main shaft 3*f* and is disposed against the inner wall of the cylindrical support housing 11*f* in such a way as to be sealed off relative to medium.

In a manner similar to the embodiment of FIG. 6, an axial flow channel 52*f* passes through over the entire length of the support bearing 20*f*; the flow channel 52*f* extends from the support housing 11*f* to the main shaft 3*f*. Starting from the main shaft 3*f*, the flow channel 52*f* continuously widens radially outwardly, so that liquid, which enters the support housing 11*f*, can reliably flow off. The support bearing 20*f* can be disposed in the pump in the same manner as with the embodiment of FIG. 6.

The present invention is, of course, in no way restricted to the specific disclosure of the specification and drawings, but also encompasses any modifications within the scope of the appended claims.

What I claim is:

1. A pump, especially a drum or immersion pump, for conveying medium; said pump comprising:

a support housing having a pressure reduction chamber;

a main shaft having two ends, one of which is adapted to be connected to a drive unit, and the other of which supports a rotor; said support housing having an inner chamber which surrounds said main shaft;

a rotor housing which has a rotor chamber in which said rotor is accommodated, said pressure reduction chamber of said support housing being located in a region above said rotor chamber;

support bearing means disposed about said main shaft and in said inner chamber of said support housing for supporting said main shaft in the latter; said support bearing means being provided with passage means and having a cross section which is less than the cross section of said inner chamber of said support housing at that location; at least one of said support housing and said rotor housing being provided with at least one discharge opening, via which said passage means communicates with the space around said pump and being connected with said discharge opening such that no connection exists to the medium being conveyed;

an outlet for medium being conveyed;

a riser channel which extends parallel to said support housing and establishes communication between said rotor chamber and said outlet, said support housing in the region above said rotor chamber having the pressure-reduction chamber so that there is precluded that any conveyed medium can rise upwardly as a consequence of a pressure build-up in said support housing; and a guide bearing disposed about said main shaft in the vicinity of said rotor.

2. A pump, especially a drum or immersion pump, for conveying medium; said pump comprising:

a support housing having a pressure reduction chamber;

a main shaft having two ends, one of which is adapted to be connected to a drive unit, and the other of which supports a rotor; said support housing having an inner chamber which surrounds said main shaft;

a rotor housing which has a rotor chamber in which said rotor is accommodated, said pressure reduction chamber of said support housing being located in a region above said rotor chamber;

support bearing means disposed about said main shaft and in said inner chamber of said support housing for supporting said main shaft in the latter;

an outlet for medium being conveyed;

a riser channel which extends parallel to said support housing and establishes communication between said rotor chamber and said outlet, said support housing in the region above said rotor chamber having the pressure reduction chamber so that there is precluded that any conveyed medium can rise upwardly as a consequence of a pressure build-up in said support housing; and a guide bearing disposed about said main shaft in the vicinity of said rotor; said guide bearing being provided with passage means and having a cross section which is less than the cross section of said inner chamber of said support housing at that location.

3. A pump, especially a drum or immersion pump, for conveying medium; said pump comprising:

a support housing having a pressure reduction chamber;

a main shaft having two ends, one of which is adapted to be connected to a drive unit, and the other of which supports a rotor; said support housing having an inner chamber which surrounds said main shaft;

a rotor housing which has a rotor chamber in which said rotor is accommodated, said pressure reduction chamber of said support housing being located in a region above said rotor chamber;

support bearing means disposed about said main shaft and in said inner chamber of said support housing for supporting said main shaft in the latter; said support bearing means being provided with passage means and having a cross section which is less than the cross section of said inner chamber of said support housing at that location; at least one of said support housing and said rotor housing being provided with at least one discharge opening, via which said at least one first passage communicates with the space around said pump and being connected with said discharge opening such that no connection exists to the medium being conveyed;

an outlet for medium being conveyed;

a riser channel which extends parallel to said support housing and establishes communication between said rotor chamber and said outlet, said support housing in the region above said rotor chamber having the pressure reduction chamber so that there is precluded that any conveyed medium can rise upwardly as a consequence of a pressure build-up in said support housing; and a guide bearing disposed about said main shaft in the vicinity of said rotor; said guide bearing being provided with passage means and having a cross section which is less than the cross section of said inner chamber of said support housing at that location.

4. A pump according to claim 3, in which each of said passage means of said support bearing means is formed by an axially extending flow channel.

5. A pump according to claim 4, in which said passage means of said guide bearing is an axially extending channel.

6. A pump according to claim 5, in which said passage means of said guide bearing is essentially aligned with said passage means of said support bearing means.

7. A pump according to claim 6, in which said passage means of said guide bearing communicates directly with said passage means of said support bearings, forms the bottom termination of said support housing and is mounted on an inner wall of the latter.

8. A pump according to claim 5, which includes a riser disposed around said support housing, with said riser channel being formed between said riser and said support housing.

9. A pump according to claim 8, in which said riser has an end which is connected to said rotor housing in such a way that the latter extends over said riser in the axial direction, with that end of said support housing remote from said drive unit projecting into said rotor housing.

10. A pump according to claim 9, in which said at least one discharge opening is provided in said rotor housing.

11. A pump according to claim 10, in which said at least one discharge opening is disposed axially beyond said riser; and which includes respective tubes for connecting said discharge openings to said second passage of said guide bearing.

12. A pump according to claim 5, in which said passage means of each of said support bearing means is provided in that portion of the latter remote from said main shaft.

13. A pump according to claim 12, in which each of said passage means of said support bearing means is formed by an axially extending recessed portion in the periphery of said support bearing; and which includes respective connecting channels in said support bearing means which extend from each of said recessed portions to said main shaft.

14. A pump according to claim 5, in which said support bearing includes two bearing parts which are mirror symmetrical to one another, which rest against an inner wall of said support housing, and which form said passage means of support bearing means therebetween.

* * * * *